US011009254B2

(12) United States Patent
Mikami

(10) Patent No.: US 11,009,254 B2
(45) Date of Patent: May 18, 2021

(54) AIR CONDITIONER HAVING RELAY COIL ABNORMALITY VOLTAGE CONTROL

(71) Applicant: Mitsubishi Electric Corporation, Tokyo (JP)

(72) Inventor: Nobuhiro Mikami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 32 days.

(21) Appl. No.: 16/461,150

(22) PCT Filed: Feb. 16, 2017

(86) PCT No.: PCT/JP2017/005771
§ 371 (c)(1),
(2) Date: May 15, 2019

(87) PCT Pub. No.: WO2018/150521
PCT Pub. Date: Aug. 23, 2018

(65) Prior Publication Data
US 2019/0368767 A1 Dec. 5, 2019

(51) Int. Cl.
*H01H 47/04* (2006.01)
*F24F 11/88* (2018.01)
(Continued)

(52) U.S. Cl.
CPC ..... *F24F 11/88* (2018.01); *H01H 47/002* (2013.01); *H01H 47/10* (2013.01); *H01H 47/04* (2013.01);
(Continued)

(58) Field of Classification Search
CPC ..... H01H 2047/006; H01H 47/04; H01H 2047/008; H01H 47/10; H01H 47/32; H01H 47/325; H01H 47/002; F24F 11/88
See application file for complete search history.

(56) References Cited

U.S. PATENT DOCUMENTS 4,038,061 A * 7/1977 Anderson ..... F25B 49/02 62/126
5,568,349 A * 10/1996 Kowalewski ..... H01H 47/04 361/154
(Continued)

FOREIGN PATENT DOCUMENTS

JP S54-076658 U1 11/1979
JP H08-178391 A 7/1996
(Continued)

OTHER PUBLICATIONS

Machine translation of JP210146189A using JPLAT; 21 pages, Dec. 2020.*
(Continued)

*Primary Examiner* — Harry R Behm
(74) *Attorney, Agent, or Firm* — Posz Law Group, PLC

(57) ABSTRACT

An air conditioner includes an outdoor unit, a relay circuit which includes a contact and a relay coil, and a control unit which causes a first voltage equal to or higher than an operating voltage or a second voltage lower than the operating voltage and equal to or higher than a retention voltage to be applied to the relay coil. One end portion of the contact is connected to an alternating-current power supply and the
(Continued)

other end portion of the contact is connected to the outdoor unit. One end portion of the relay coil is connected to a power supply for driving the relay circuit. The control unit causes a second voltage to be applied to the relay coil after the contact is turned ON, and causes the first voltage to be applied to the relay coil at a predetermined constant period.

2 Claims, 5 Drawing Sheets

(51) Int. Cl.
*H01H 47/00* (2006.01)
*H01H 47/10* (2006.01)
*H01H 47/32* (2006.01)

(52) U.S. Cl.
CPC ..... *H01H 47/32* (2013.01); *H01H 2047/006* (2013.01); *H01H 2047/008* (2013.01)

(56) References Cited

U.S. PATENT DOCUMENTS

2005/0024102 A1* 2/2005 Kondo ..... H01H 47/002 327/110
2007/0146959 A1* 6/2007 Morita ..... H01H 47/04 361/160
2012/0002341 A1* 1/2012 Lenz ..... H01H 47/22 361/187
2013/0083444 A1* 4/2013 Barnes ..... H01H 47/04 361/211
2016/0171878 A1* 6/2016 Komatsu ..... G08C 17/02 340/12.5
2016/0358732 A1* 12/2016 Nishio ..... H01H 47/002

FOREIGN PATENT DOCUMENTS

JP H11-072261 A 3/1999
JP 2001-091013 A 4/2001
JP 2004-072806 A 3/2004
JP 2006-003043 A 1/2006
JP 2010146819 A * 7/2010
JP 2010-175132 A 8/2010
JP 2011-113781 A 6/2011
JP 2014-116197 A 6/2014

OTHER PUBLICATIONS

Office Action dated Jan. 7, 2020 issued in corresponding JP patent application No. 2019-500113 (and English translation).
Office Action dated May 7, 2020 issued in corresponding JP patent application No. 2019-500113 (and English translation).
Extended EP Search Report dated Feb. 25, 2019 issued in corresponding EP patent application No. 17892077.3.
International Search Report dated Apr. 25, 2017 issued in corresponding international patent application No. PCT/JP2017/005771.
Office Action dated Sep. 22, 2020 issued in corresponding IN patent application No. 2019-47030015 (and English translation).
Office Action dated Dec. 22, 2020 issued in corresponding JP patent application No. 2019-500113 (and English translation).

* cited by examiner

AIR CONDITIONER HAVING RELAY COIL ABNORMALITY VOLTAGE CONTROL

CROSS REFERENCE TO RELATED APPLICATION

This application is a U.S. national stage application of International Patent Application No. PCT/JP2017/005771 filed on Feb. 16, 2017, the disclosure of which is incorporated herein by reference.

TECHNICAL FIELD

The present invention relates to an air conditioner which performs air conditioning.

BACKGROUND

In electrical appliances, relay circuits are used to drive other circuits. In an air conditioner as well, a relay circuit is used to perform switching between a state of supplying power to an outdoor unit and a state of not supplying power to the outdoor unit. Conventionally, a technique has been proposed in which in order to drive a relay circuit at low power consumption and to suppress an increase in temperature of the relay circuit, a direct-current voltage equal to or higher than an operating voltage is applied to a relay coil at a start of an ON state of a contact, and after a certain time has elapsed, a direct-current voltage lower than the operating voltage and equal to or higher than a retention voltage is applied to the relay coil (see, for example, Patent Literature 1). In addition, a technique has been proposed in which even in a case where an actuator is driven when a voltage applied to a relay coil is a retention voltage and thereby the retention voltage decreases, a contact is not interrupted (see, for example, Patent Literature 2).

PATENT LITERATURE

Patent Literature 1: Japanese Patent Application Laid-open No. 2004-72806

Patent Literature 2: Japanese Patent Application Laid-open No. 2011-113781

However, in the above-described conventional techniques, in a case where a voltage of an alternating-current power supply is reduced by, for example, a momentary power failure when the voltage applied to the relay coil is the retention voltage, the voltage applied to the relay coil also decreases accordingly. Consequently, the contact is interrupted. When the contact is interrupted, a user needs to set an operation of the air conditioner to an OFF state and then to set the operation of the air conditioner to an ON state.

SUMMARY

The present invention has been made in view of the above, and an object of the present invention is to provide an air conditioner capable of resuming operation without requiring operation by a user and without notifying the user of an abnormality even in a case where the abnormality occurs in an outdoor unit when a voltage applied to a relay coil is a retention voltage and thereby a contact is interrupted.

In order to solve the above problem and achieve the object, an air conditioner according to the present invention includes an indoor unit, an outdoor unit, a relay circuit including a contact and a relay coil, a control unit which causes a first voltage equal to or higher than an operating voltage for turning ON the contact or a second voltage lower than the operating voltage and equal to or higher than a retention voltage for retaining a state in which the contact is ON to be applied to the relay coil, and an abnormality detection unit to, when an abnormality occurs in the outdoor unit, detect occurrence of the abnormality in the outdoor unit. The indoor unit includes a notification unit to, when the abnormality detection unit detects that an abnormality has occurred in the outdoor unit, notify that the abnormality has occurred in the outdoor unit. One end portion of two end portions of the contact is connected to an alternating-current power supply and another end portion of the two end portions of the contact is connected to the outdoor unit. One end portion of two end portions of the relay coil is connected to a power supply for driving the relay circuit. The control unit causes the first voltage to be applied to the relay coil at a start of an ON state of the contact, causes the second voltage to be applied to the relay coil after the contact is turned ON, and causes the first voltage to be applied to the relay coil during a period from detection of occurrence of the abnormality to notification of the occurrence of the abnormality by the notification unit when the abnormality detection unit detects that the abnormality has occurred.

The air conditioner according to the present invention has an effect of resuming operation without requiring operation by a user and without notifying the user of an abnormality even in a case where the abnormality occurs in an outdoor unit when a voltage applied to a relay coil is a retention voltage and thereby a contact is interrupted.

DETAILED DESCRIPTION

Hereinafter, an air conditioner according to each embodiment of the present invention will be described in detail with reference to the drawings. The invention is not limited to the embodiments.

First Embodiment

Figure 1:
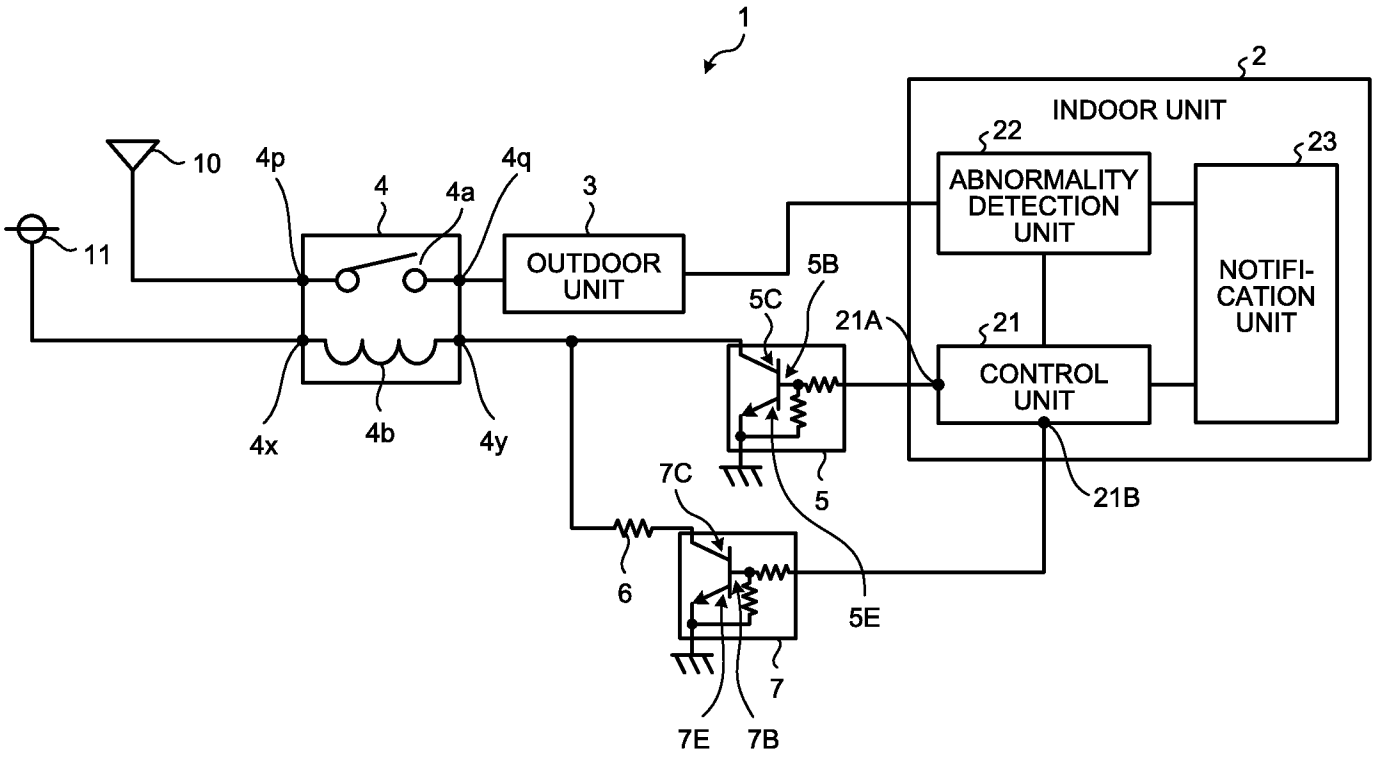
FIG. 1 is a diagram illustrating a configuration of an air conditioner according to a first embodiment.

FIG. 1 is a diagram illustrating a configuration of an air conditioner 1 according to a first embodiment. As illustrated in FIG. 1, the air conditioner 1 includes an indoor unit 2, an outdoor unit 3, a relay circuit 4 including a contact 4*a* and a relay coil 4*b*, a first transistor 5 connected to the relay circuit 4, a resistor 6 connected to the relay circuit 4, and a second transistor 7 connected to the resistor 6.

The indoor unit 2 includes a control unit 21, which causes a first voltage or a second voltage to be applied to the relay coil 4*b*. The first voltage is equal to or higher than an operating voltage to turn ON the contact 4*a*. The second voltage is lower than the operating voltage and equal to or higher than a retention voltage for retaining the state in which the contact 4*a* is ON. The first voltage and the second voltage are direct-current voltages. The control unit 21 includes a first control port 21A to which the first transistor 5 is connected and a second control port 21B to which the second transistor 7 is connected. The indoor unit 2 further includes an abnormality detection unit 22 and a notification unit 23.

One end portion 4*p* of two end portions 4*p* and 4*q* of the contact 4*a* included in the relay circuit 4 is connected to an alternating-current power supply 10. The other end portion 4*q* of the two end portions 4*p* and 4*q* of the contact 4*a* is connected to the outdoor unit 3. One end portion 4*x* of two end portions 4*x* and 4*y* of the relay coil 4*b* included in the relay circuit 4 is connected to a power supply 11 for driving the relay circuit 4. A voltage of the power supply 11 for driving the relay circuit 4 is affected by a voltage of the alternating-current power supply 10. The other end portion 4*y* of the two end portions 4*x* and 4*y* of the relay coil 4*b* is connected to the first transistor 5 and the resistor 6.

A base 5B of the first transistor 5 is connected to the first control port 21A of the control unit 21, an emitter 5E of the first transistor 5 is grounded, and a collector 5C of the first transistor 5 is connected to the other end portion 4*y* of the relay coil 4*b*. The first transistor 5 performs switching between an ON state in which the first voltage is applied to the relay coil 4*b* and an OFF state in which the first voltage is not applied to the relay coil 4*b*.

A base 7B of the second transistor 7 is connected to the second control port 21B of the control unit 21, an emitter 7E of the second transistor 7 is grounded, and a collector 7C of the second transistor 7 is connected to one of two end portions of the resistor 6. The other of the two end portions of the resistor 6 is connected to the relay coil 4*b*. In order to suppress power consumption, the resistor 6 limits a current flowing through the relay coil 4*b*. The second transistor 7 performs switching between an ON state in which the second voltage is applied to the relay coil 4*b* and an OFF state in which the second voltage is not applied to the relay coil 4*b*.

The control unit 21 causes the first voltage to be applied to the relay coil 4*b* at a start of an ON state of the contact 4*a* and causes the second voltage to be applied to the relay coil 4*b* after the contact 4*a* is turned ON. In addition, the control unit 21 causes the first voltage to be applied to the relay coil 4*b* at a predetermined constant period. For example, the control unit 21 causes not the second voltage but the first voltage to be applied to the relay coil 4*b* at the predetermined constant period.

Figure 2:
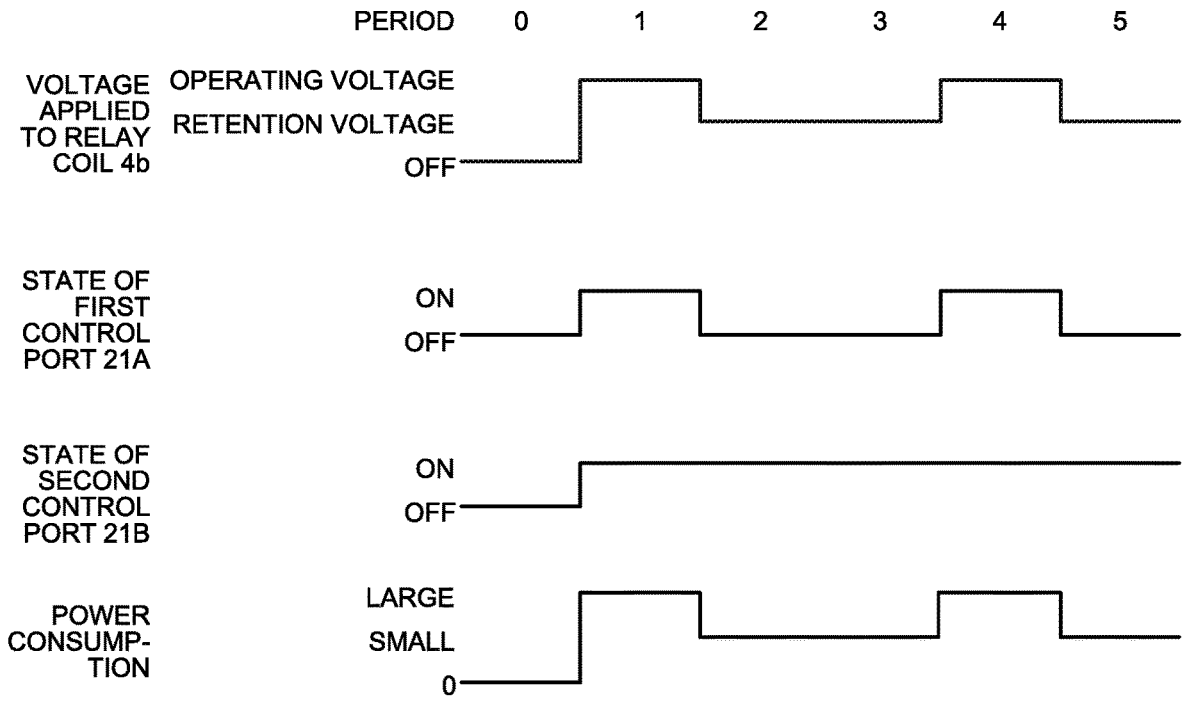
FIG. 2 is a timing chart for explaining control performed by a control unit included in the air conditioner according to the first embodiment.

Next, control performed by the control unit 21 will be described. FIG. 2 is a timing chart for explaining the control performed by the control unit 21 included in the air conditioner 1 according to the first embodiment. Specifically, FIG. 2 illustrates changes with time of each of a voltage applied to the relay coil 4*b*, a state of each of the first control port 21A and the second control port 21B of the control unit 21, and a magnitude of the power consumption in the relay coil 4*b*, for six successive periods. In FIG. 2, the operating voltage as an example of the first voltage is illustrated for the first voltage and the retention voltage as an example of the second voltage is illustrated for the second voltage. The state of each of the first control port 21A and the second control port 21B is either of an ON state or an OFF state for each of the first control port 21A and the second control port 21B.

In a 0-th period, both the first control port 21A and the second control port 21B are OFF. Therefore, the driving voltage is not applied to the relay coil 4*b*. Accordingly, the relay coil 4*b* does not consume power. The contact 4*a* is OFF.

In a first period following the 0-th period, the control unit 21 turns ON both the first control port 21A and the second control port 21B. When the first control port 21A is switched from OFF to ON, the first voltage is applied to the relay coil 4*b*. Therefore, the contact 4*a* is turned ON, and alternating-current power from the alternating-current power supply 10 is supplied to the outdoor unit 3. In the first period, since the first voltage higher than the second voltage is applied to the relay coil 4*b* as described above, the power consumption of the relay coil 4*b* is relatively large.

In a second period following the first period, the control unit 21 turns OFF the first control port 21A and maintains the ON state of the second control port 21B. Since the second control port 21B is ON, the second voltage is applied to the relay coil 4*b*, the ON state of the contact 4*a* is maintained, and the alternating-current power from the alternating-current power supply 10 is supplied to the outdoor unit 3. In the second period, since the second voltage lower than the first voltage is applied to the relay coil 4*b* as described above, the power consumption of the relay coil 4*b* is relatively small. That is, the power consumption of the relay coil 4*b* in the second period is smaller than the power consumption of the relay coil 4*b* in the first period.

In a third period following the second period, the control unit 21 maintains the control performed in the second period described above. That is, in the third period, the control unit 21 maintains the state in which the first control port 21A is OFF and the second control port 21B is ON. Since the second control port 21B is ON, the second voltage is applied to the relay coil 4*b*, the ON state of the contact 4*a* is maintained, and the alternating-current power from the alternating-current power supply 10 is supplied to the outdoor unit 3. In the third period, since the second voltage lower than the first voltage is applied to the relay coil 4*b* as described above, the power consumption of the relay coil 4*b* is relatively small.

In a fourth period following the third period, the control unit 21 maintains the ON state of the second control port 21B, and turns ON the first control port 21A. The fourth period is one of periods during which the control unit 21 causes the first voltage to be applied to the relay coil 4*b* at the predetermined constant period. When the first control port 21A is switched from OFF to ON, the first voltage higher than the second voltage is applied to the relay coil 4*b*.

Since the first voltage is applied to the relay coil 4*b*, the ON state of the contact 4*a* is maintained, and the alternating-current power from the alternating-current power supply 10 is supplied to the outdoor unit 3. In the fourth period, since the first voltage higher than the second voltage is applied to the relay coil 4*b* as described above, the power consumption of the relay coil 4*b* is relatively large. That is, the power consumption of the relay coil 4*b* in the fourth period is larger than the power consumption of the relay coil 4*b* in the second period and the third period.

In a fifth period following the fourth period, similarly to the second period, the control unit 21 turns OFF the first control port 21A and maintains the ON state of the second control port 21B. Since the second control port 21B is ON, the second voltage is applied to the relay coil 4*b*, the ON state of the contact 4*a* is maintained, and the alternating-current power from the alternating-current power supply 10 is supplied to the outdoor unit 3. In the fifth period, since the second voltage lower than the first voltage is applied to the relay coil 4*b*, the power consumption of the relay coil 4*b* is relatively small. That is, the power consumption of the relay coil 4*b* in the fifth period is smaller than the power consumption of the relay coil 4*b* in the fourth period.

As described with reference to FIG. 2, the control unit 21 causes the first voltage to be applied to the relay coil 4*b* at the start of the ON state of the contact 4*a*, and causes the second voltage lower than the first voltage to be applied to the relay coil 4*b* after the contact 4*a* is turned ON. In addition, the control unit 21 causes the first voltage to be applied to the relay coil 4*b* at the predetermined constant period.

Figure 3:
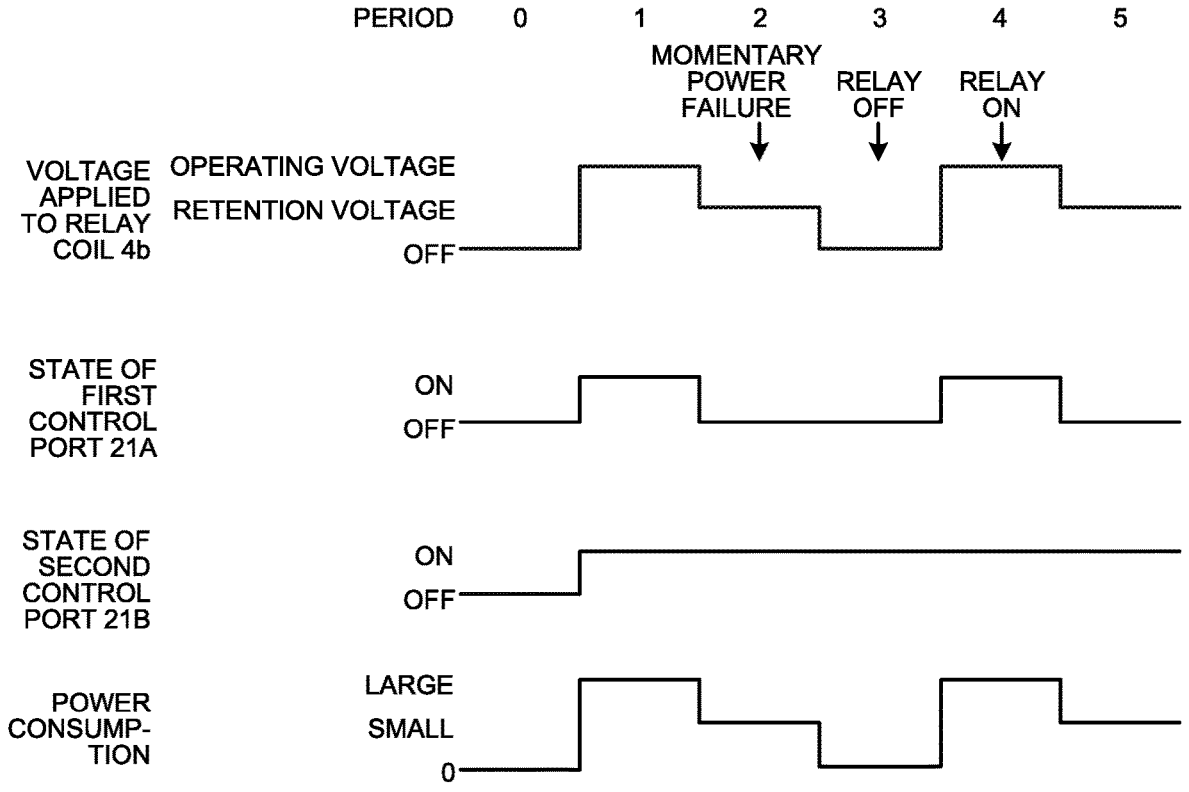
FIG. 3 is a diagram for explaining an effect obtained by the control performed by the control unit included in the air conditioner according to the first embodiment.

Next, an effect obtained by the control performed by the control unit 21 described with reference to FIG. 2 will be described. FIG. 3 is a diagram for explaining the effect obtained by the control performed by the control unit 21 included in the air conditioner 1 according to the first embodiment. Situations from the 0-th period to the first period in FIG. 3 are the same as situations from the 0-th period to the first period in FIG. 2. However, in FIG. 3, there is an assumption that a momentary power failure has occurred in the second period and the alternating-current power supply 10 has recovered in the fourth period.

When a momentary power failure occurs in the second period, only the voltage lower than the second voltage is applied to the relay coil 4*b* in the third period under the influence of the momentary power failure. Therefore, the contact 4*a* is turned OFF. If the contact 4*a* continues to be OFF, the alternating-current power from the alternating-current power supply 10 is not supplied to the outdoor unit 3 even if the momentary power failure is restored, the operation of the outdoor unit 3 continues to be stopped, and the function of the air conditioner 1 is not exerted.

However, as described with reference to FIG. 2, in the fourth period, the control unit 21 maintains the ON state of the second control port 21B, and turns ON the first control port 21A. When the first control port 21A is switched from OFF to ON, the first voltage is applied to the relay coil 4*b*, the contact 4*a* is turned ON, and the alternating-current power from the alternating-current power supply 10 is supplied to the outdoor unit 3. Since the alternating-current power from the alternating-current power supply 10 is supplied to the outdoor unit 3, the outdoor unit 3 resumes operation.

As described with reference to FIGS. 2 and 3, the control unit 21 causes the first voltage to be applied to the relay coil 4*b* at the start of the ON state of the contact 4*a*, and causes the second voltage lower than the first voltage to be applied to the relay coil 4*b* after the contact 4*a* is turned ON. In addition, the control unit 21 causes the first voltage to be applied to the relay coil 4*b* at the predetermined constant period. Therefore, even if a momentary power failure occurs, the contact 4*a* is turned ON within the above period, the alternating-current power from the alternating-current power supply 10 is supplied to the outdoor unit 3, and the outdoor unit 3 can resume operation. That is, even in a case where the voltage of the alternating-current power supply 10 is reduced when the voltage applied to the relay coil 4*b* is the retention voltage and thereby the contact 4*a* is interrupted, the air conditioner 1 can resume operation without requiring operation by a user.

In addition, the control unit 21 does not continue to cause the first voltage to be applied to the relay coil 4*b* after the contact 4*a* is turned ON, but causes the second voltage lower than the first voltage to be applied to the relay coil 4*b*. Therefore, the power consumption of the relay coil 4*b* when the control unit 21 performs the above-described control is smaller than the power consumption of the relay coil 4*b* when the first voltage is continuously applied to the relay coil 4*b*. That is, the air conditioner 1 can suppress the power consumption of the relay coil 4*b*.

The indoor unit 2 includes the abnormality detection unit 22 and the notification unit 23 as described above. When an abnormality occurs in the outdoor unit 3, the abnormality detection unit 22 detects occurrence of the abnormality in the outdoor unit 3. The notification unit 23 notifies that the abnormality has occurred in the outdoor unit 3 when the abnormality detection unit 22 detects that the abnormality has occurred in the outdoor unit 3. The control unit 21 causes not the second voltage but the first voltage to be applied to the relay coil 4*b* during a period from the detection of the occurrence of the abnormality to the notification of the occurrence of the abnormality by the notification unit 23 when the abnormality detection unit 22 detects that the abnormality has occurred in the outdoor unit 3. An example of the abnormality is that supply of the alternating-current power to the outdoor unit 3 is stopped by the momentary power failure.

That is, the control unit 21 causes the first voltage to be applied to the relay coil 4*b* at the start of the ON state of the contact 4*a*, and causes the second voltage lower than the first voltage to be applied to the relay coil 4*b* after the contact 4*a* is turned ON. In addition, the control unit 21 causes the first voltage to be applied to the relay coil 4*b* during the period from the detection of the occurrence of the abnormality to the notification of the occurrence of the abnormality by the notification unit 23 when the abnormality detection unit 22 detects that the abnormality has occurred in the outdoor unit 3. For example, the control unit 21 causes not the second voltage but the first voltage to be applied to the relay coil 4*b* during the period from the detection of the occurrence of the abnormality to the notification of the occurrence of the abnormality by the notification unit 23 when the abnormality detection unit 22 detects that the abnormality has occurred in the outdoor unit 3.

When an abnormality occurs in the outdoor unit 3, the notification unit 23 does not notify the occurrence of the abnormality in the outdoor unit 3 immediately after the abnormality occurs in the outdoor unit 3. The notification unit 23 notifies that the abnormality has occurred in the outdoor unit 3 after confirming that the abnormality occurring in the outdoor unit 3 has continued for a predetermined period. An example of the predetermined period is three minutes. As described above, the control unit 21 causes the first voltage to be applied to the relay coil 4*b* during a period from the detection of the occurrence of the abnormality to a time at which the predetermined period elapses when the abnormality detection unit 22 detects that the abnormality has occurred in the outdoor unit 3. For example, the control unit 21 causes the first voltage to be applied to the relay coil 4*b* after two minutes and 30 seconds have elapsed from the detection of the occurrence of the abnormality.

By the control unit 21 performing the above-described control, even if an abnormality occurs in the outdoor unit 3, for example, due to occurrence of a momentary power failure, the contact 4*a* is turned ON before the notification unit 23 notifies that the abnormality has occurred in the outdoor unit 3, the alternating-current power from the alternating-current power supply 10 is supplied to the outdoor unit 3, and the outdoor unit 3 can resume operation. That is, even in a case where the abnormality occurs in the outdoor unit 3 when the voltage applied to the relay coil 4*b* is the retention voltage and thereby the contact 4*a* is interrupted, the air conditioner 1 can resume operation without requiring operation by the user, and without notifying the user of the abnormality. Besides, even if an abnormality occurs in the outdoor unit 3, the user can enjoy a function of the air conditioner 1 without being conscious of the abnormality.

The abnormality detection unit 22 further has a function of detecting occurrence of an abnormality in communication between the indoor unit 2 and the outdoor unit 3 when the abnormality occurs in the communication. The control unit 21 causes the first voltage to be applied to the relay coil 4*b* when the abnormality detection unit 22 detects that an abnormality has occurred in communication. That is, the control unit 21 causes the first voltage to be applied to the relay coil 4*b* at the start of the ON state of the contact 4*a*, and causes the second voltage lower than the first voltage to be applied to the relay coil 4*b* after the contact 4*a* is turned ON. In addition, the control unit 21 causes the first voltage to be applied to the relay coil 4*b* when the abnormality detection unit 22 detects that the abnormality has occurred in the communication. For example, the control unit 21 causes not the second voltage but the first voltage to be applied to the relay coil 4*b* when the abnormality detection unit 22 detects that the abnormality has occurred in the communication.

For example, when the momentary power failure occurs and the contact 4*a* is turned OFF, the operation of the outdoor unit 3 is stopped. When the operation of the outdoor unit 3 is stopped, an abnormality occurs in the communication between the indoor unit 2 and the outdoor unit 3, and the abnormality detection unit 22 detects occurrence of the abnormality in the communication between the indoor unit 2 and the outdoor unit 3. When the abnormality detection unit 22 detects that the abnormality has occurred in the communication, the control unit 21 causes the first voltage to be applied to the relay coil 4*b*.

By the control unit 21 performing the above-described control, even if an abnormality occurs in communication between the indoor unit 2 and the outdoor unit 3, for example, due to occurrence of a momentary power failure, the first voltage is applied to the relay coil 4*b* when the abnormality detection unit 22 detects that the abnormality has occurred in the communication, the contact 4*a* is turned ON, the alternating-current power from the alternating-current power supply 10 is supplied to the outdoor unit 3, and the outdoor unit 3 resumes operation. That is, even in a case where the abnormality occurs in the communication between the indoor unit 2 and the outdoor unit 3 when the voltage applied to the relay coil 4*b* is the retention voltage and thereby the contact 4*a* is interrupted, the air conditioner 1 can resume operation without requiring operation by the user, and without causing the user to be conscious of the abnormality.

One or both of the control unit 21 and the abnormality detection unit 22 may be provided outside the indoor unit 2.

Figure 4:
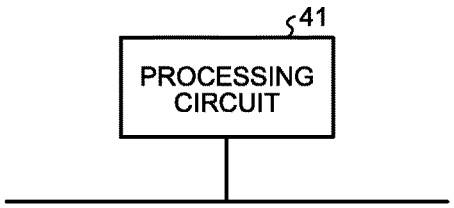
FIG. 4 is a diagram illustrating a processing circuit in a case where at least a part of constituent elements constituting the control unit, an abnormality detection unit, and a notification unit included in the air conditioner according to the first embodiment is achieved by the processing circuit.

FIG. 4 is a diagram illustrating a processing circuit 41 in a case where at least a part of constituent elements constituting the control unit 21, the abnormality detection unit 22, and the notification unit 23 included in the air conditioner 1 according to the first embodiment is achieved by the processing circuit 41. That is, at least a part of functions of the control unit 21, the abnormality detection unit 22, and the notification unit 23 may be achieved by the processing circuit 41.

The processing circuit 41 is dedicated hardware. The processing circuit 41 is, for example, a single circuit, a composite circuit, a programmed processor, a parallel programmed processor, an Application Specific Integrated Circuit (ASIC), a Field-Programmable Gate Array (FPGA), or a combination thereof. A part of the control unit 21, the abnormality detection unit 22, and the notification unit 23 may be dedicated hardware separate from the remainder.

Figure 5:
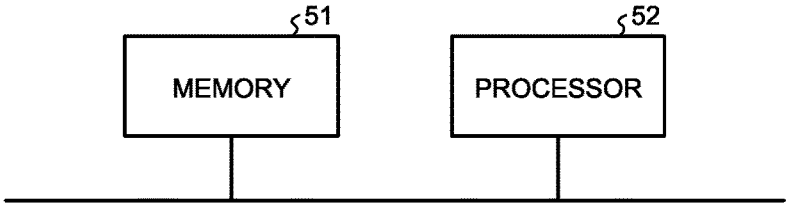
FIG. 5 is a diagram illustrating a processor in a case where at least a part of functions of the control unit, the abnormality detection unit, and the notification unit included in the air conditioner according to the first embodiment is achieved by the processor.

FIG. 5 is a diagram illustrating a processor 52 in a case where at least a part of the functions of the control unit 21, the abnormality detection unit 22, and the notification unit 23 included in the air conditioner 1 according to the first embodiment is achieved by the processor 52. That is, at least a part of the functions of the control unit 21, the abnormality detection unit 22, and the notification unit 23 may be achieved by the processor 52 executing a program stored in a memory 51. The processor 52 is a Central Processing Unit (CPU), a processing device, an arithmetic device, a microprocessor, a microcomputer, or a Digital Signal Processor (DSP). FIG. 5 also illustrates the memory 51.

In the case where at least a part of the functions of the control unit 21, the abnormality detection unit 22, and the notification unit 23 is achieved by the processor 52, the part of the functions is achieved by a combination of the processor 52 and software, firmware, or software and firmware. The software or the firmware is described as a program and stored in the memory 51. By reading and executing the program stored in the memory 51, the processor 52 achieves at least a part of the functions of the control unit 21, the abnormality detection unit 22, and the notification unit 23.

That is, when at least a part of the functions of the control unit 21, the abnormality detection unit 22, and the notification unit 23 is achieved by the processor 52, the air conditioner 1 includes the memory 51 for storing a program with which a step is executed as a result, the step being executed by at least a part of the control unit 21, the abnormality detection unit 22, and the notification unit 23. It can be said that the program stored in the memory 51 causes a computer to execute a procedure or method executed by at least a part of the control unit 21, the abnormality detection unit 22, and the notification unit 23.

The memory 51 is, for example, a non-volatile or volatile semiconductor memory such as a Random Access Memory (RAM), a Read Only Memory (ROM), a flash memory, an Erasable Programmable Read Only Memory (EPROM), or an Electrically Erasable Programmable Read Only Memory (EEPROM), a magnetic disk, a flexible disk, an optical disk, a compact disc, a mini disk, or a Digital Versatile Disk (DVD).

Regarding a plurality of functions of the control unit 21, the abnormality detection unit 22, and the notification unit 23, a part of the functions may be achieved by dedicated hardware and the remainder of the functions may be achieved by software or firmware. Thus, the functions of the control unit 21, the abnormality detection unit 22, and the notification unit 23 can be achieved by hardware, software, firmware, or a combination thereof.

Second Embodiment

Figure 6:
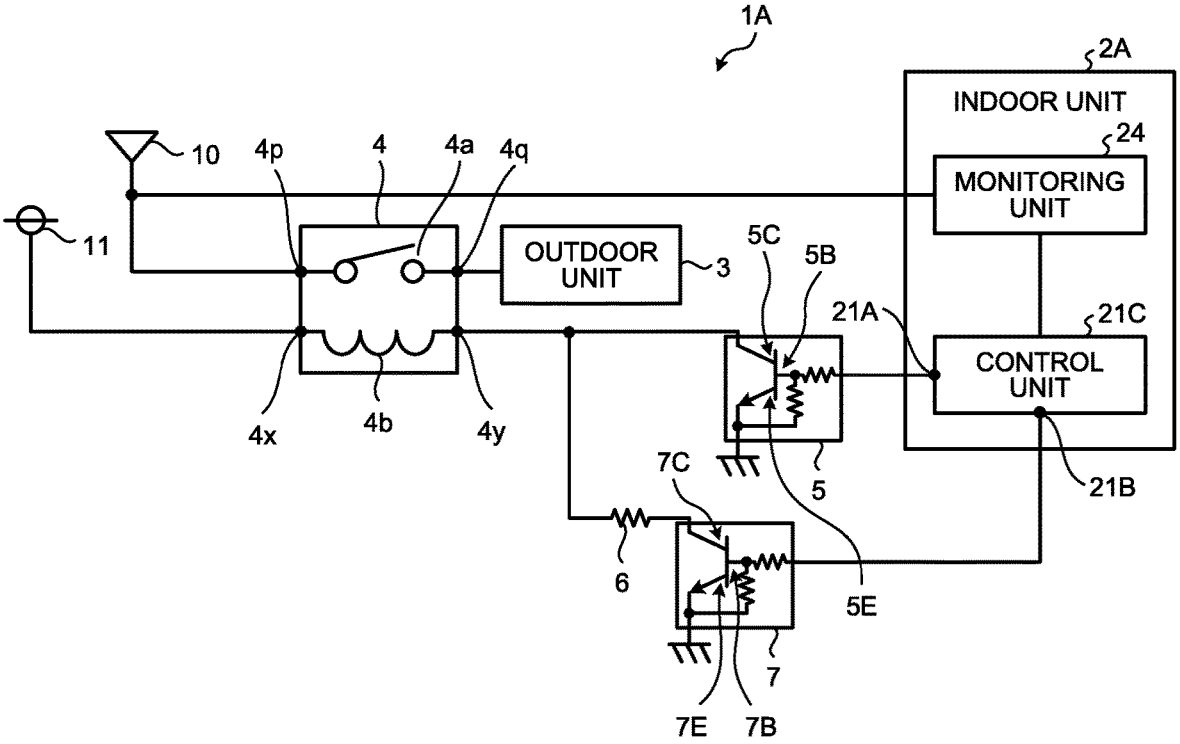
FIG. 6 is a diagram illustrating a configuration of an air conditioner according to a second embodiment.

FIG. 6 is a diagram illustrating a configuration of an air conditioner 1A according to a second embodiment. As is apparent from a comparison between FIG. 6 and FIG. 1, the air conditioner 1A includes an indoor unit 2A instead of the indoor unit 2. The indoor unit 2A includes a monitoring unit 24, which monitors a voltage of the alternating-current power supply 10. The monitoring unit 24 monitors the voltage of the alternating-current power supply 10, for example, by converting alternating-current power from the alternating-current power supply 10 into direct-current power and dividing a voltage by resistors.

The indoor unit 2A includes a control unit 21C instead of the control unit 21 included in the indoor unit 2. The control unit 21C includes the first control port 21A and the second control port 21B. The air conditioner 1A further includes the outdoor unit 3, the relay circuit 4, the first transistor 5, the resistor 6, and the second transistor 7 included in the air conditioner 1 according to the first embodiment. The control unit 21C causes the first voltage to be applied to the relay coil 4*b* at a start of an ON state of the contact 4*a* and causes the second voltage to be applied to the relay coil 4*b* after the contact 4*a* is turned ON. In addition, when the monitoring unit 24 monitors that the voltage of the alternating-current power supply 10 is lower than a predetermined value, the control unit 21C causes the first voltage to be applied to the relay coil 4*b*.

Figure 7:
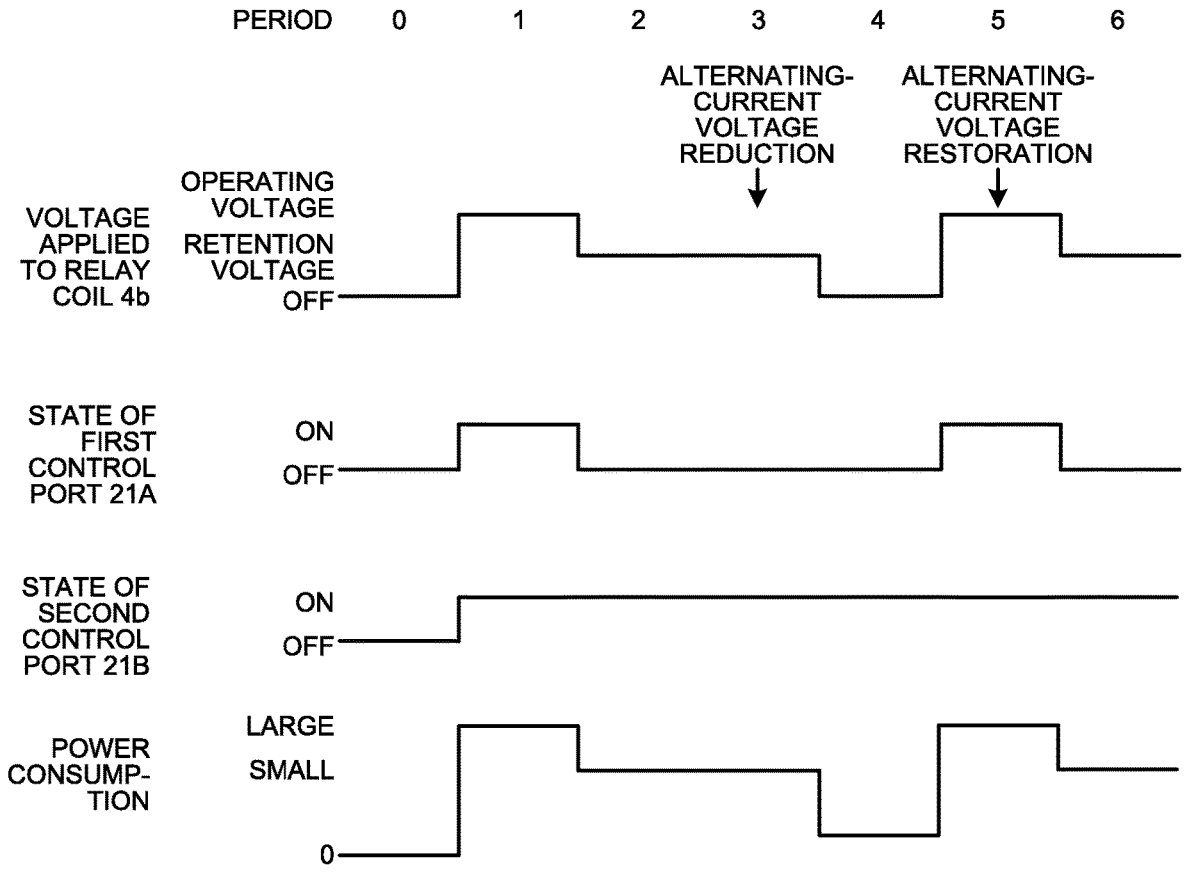
FIG. 7 is a timing chart for explaining control performed by a control unit included in the air conditioner according to the second embodiment.

Next, control performed by the control unit 21C will be described. FIG. 7 is a timing chart for explaining the control performed by the control unit 21C included in the air conditioner 1A according to the second embodiment. Specifically, FIG. 7 illustrates changes with time of each of a voltage applied to the relay coil 4*b*, a state of each of the first control port 21A and the second control port 21B of the control unit 21C, and a magnitude of power consumption in the relay coil 4*b*, for seven successive periods. In FIG. 7, an operating voltage as an example of the first voltage is illustrated for the first voltage and a retention voltage as an example of the second voltage is illustrated for the second voltage. The state of each of the first control port 21A and the second control port 21B is either of an ON state or an OFF state for each of the first control port 21A and the second control port 21B.

As is apparent from a comparison between FIG. 7 and FIG. 2, situations from a 0-th period to a second period in FIG. 7 are the same as situations from the 0-th period to the second period in FIG. 2. In FIG. 7, there is an assumption that the voltage of the alternating-current power supply 10 becomes lower than the predetermined value in a third period, and the voltage of the alternating-current power supply 10 becomes equal to or higher than the predetermined value in a fifth period. In FIG. 7, the term "alternating-current voltage reduction" indicates that the voltage of the alternating-current power supply 10 becomes lower than the predetermined value in the third period. Similarly, the term "alternating-current voltage restoration" indicates that the voltage of the alternating-current power supply 10 becomes equal to or higher than the predetermined value in the fifth period. In the above case, the monitoring unit 24 monitors that the voltage of the alternating-current power supply 10 is lower than the predetermined value in the third period. In addition, the monitoring unit 24 monitors that the voltage of the alternating-current power supply 10 is equal to or higher than the predetermined value in the fifth period.

When the voltage of the alternating-current power supply 10 becomes lower than the predetermined value, only the voltage lower than the second voltage is applied to the relay coil 4*b* in a fourth period. Therefore, the contact 4*a* is turned OFF. When the contact 4*a* is turned OFF, the alternating-current power from the alternating-current power supply 10 is not supplied to the outdoor unit 3, and operation of the outdoor unit 3 is stopped.

Since the monitoring unit 24 monitors that the voltage of the alternating-current power supply 10 is equal to or higher than the predetermined value in the fifth period, the control unit 21C maintains the ON state of the second control port 21B, and turns ON the first control port 21A. When the first control port 21A is switched from OFF to ON, the first voltage is applied to the relay coil 4*b*, and the contact 4*a* is turned ON. The supply of the alternating-current power from the alternating-current power supply 10 to the outdoor unit 3 is resumed, and the outdoor unit 3 resumes operation.

In a sixth period, the control unit 21C maintains the ON state of the second control port 21B, and turns OFF the first control port 21A. By the control unit 21C turning OFF the first control port 21A, the power consumption of the relay coil 4*b* decreases.

As described above, the control unit 21C causes the first voltage to be applied to the relay coil 4*b* at the start of the ON state of the contact 4*a* and causes the second voltage to be applied to the relay coil 4*b* after the contact 4*a* is turned ON. In addition, when the monitoring unit 24 monitors that the voltage of the alternating-current power supply 10 is lower than the predetermined value, the control unit 21C causes the first voltage to be applied to the relay coil 4*b*. For example, when the monitoring unit 24 monitors that the voltage of the alternating-current power supply 10 is lower than the predetermined value, the control unit 21C causes not the second voltage but the first voltage to be applied to the relay coil 4*b*. That is, even if the voltage of the alternating-current power supply 10 becomes lower than the predetermined value and the contact 4*a* is turned OFF, the air conditioner 1A turns ON the contact 4*a* when the voltage of the alternating-current power supply 10 becomes equal to or higher than the predetermined value, and can resume operation without requiring operation by a user. In addition, the air conditioner 1A can reduce the power consumption of the relay coil 4*b*.

One or both of the control unit 21C and the monitoring unit 24 may be provided outside the indoor unit 2A.

At least a part of the constituent elements constituting the control unit 21C and the monitoring unit 24 may be achieved by a processing circuit equivalent to the processing circuit 41 described with reference to FIG. 4. At least a part of the functions of the control unit 21C and the monitoring unit 24 may be achieved by a processor similarly to the processor 52 described with reference to FIG. 5.

The configuration described in each embodiment above indicates one example of the content of the present invention and can be combined with other known technology, and a part thereof can be omitted or modified without departing from the gist of the present invention.

The invention claimed is:

1. An air conditioner comprising:

an indoor unit;

an outdoor unit;

a relay circuit including a contact and a relay coil;

a controller to cause a first voltage equal to or higher than an operating voltage for turning ON the contact or a second voltage lower than the operating voltage and equal to or higher than a retention voltage for retaining a state in which the contact is ON to be applied to the relay coil; and an abnormality detector to, when an abnormality occurs in the outdoor unit, detect occurrence of the abnormality in the outdoor unit, wherein the indoor unit includes an alarm to, when the abnormality detector detects that an abnormality has occurred in the outdoor unit, notify that the abnormality has occurred in the outdoor unit, one end portion of two end portions of the contact is connected to an alternating-current power supply and another end portion of the two end portions of the contact is connected to the outdoor unit, one end portion of two end portions of the relay coil is connected to a power supply for driving the relay circuit, and the controller causes the first voltage to be applied to the relay coil at a start of an ON state of the contact, causes the second voltage to be applied to the relay coil after the contact is turned ON, and causes the first voltage to be applied to the relay coil during a period from detection of occurrence of the abnormality to notification of the occurrence of the abnormality by the alarm when the abnormality detector detects that the abnormality has occurred, and the abnormality detector, when an abnormality occurs in communication between the indoor unit and the outdoor unit, detects occurrence of the abnormality in the communication, and the controller causes the first voltage to be applied to the relay coil when the abnormality detector detects that the abnormality has occurred in the communication.

2. The air conditioner according to claim 1, further comprising:

a monitor to monitor a voltage of the alternating-current power supply, wherein the controller causes the first voltage to be applied to the relay coil when the monitor monitors that a voltage of the alternating-current power supply is lower than a predetermined value.

* * * * *